United States Patent [19]

Arai et al.

[11] Patent Number: 4,778,540

[45] Date of Patent: Oct. 18, 1988

[54] METHOD FOR SURFACE TREATMENT AND TREATING MATERIAL THEREFOR

[75] Inventors: Tohru Arai; Hatsuhiko Oikawa, both of Aichi, Japan

[73] Assignee: Kabushiki Kaisha Toyota Chuo Kenkyusho, Japan

[21] Appl. No.: 68,130

[22] Filed: Jun. 30, 1987

[30] Foreign Application Priority Data

Jul. 7, 1986 [JP] Japan ..... 61-159439

[51] Int. Cl.[4] ..... C21D 1/48

[52] U.S. Cl. ..... 148/15.5; 148/20; 148/28; 427/431

[58] Field of Search ..... 148/27, 28, 15, 15.5, 148/20, 6.11; 427/431

[56] References Cited

U.S. PATENT DOCUMENTS 3,930,060 12/1975 Komatsu et al. ..... 427/12
4,158,578 6/1979 Komatsu et al. ..... 148/6.11
4,230,751 10/1980 Komatsu et al. ..... 427/443.1
4,400,224 8/1983 Arai et al. ..... 148/15
4,453,987 6/1984 Arai et al. ..... 148/15.5

*Primary Examiner*—Christopher W. Brody
*Attorney, Agent, or Firm*—Berman, Aisenberg & Platt

[57] ABSTRACT

A method and a bath agent for forming a carbide or diffusion layer on the surface of an article to be treated by immersing the article in a molten salt bath. The salt bath comprises borax, at least one oxide of a surface layer forming element (SFE) selected from the group consisting of an oxide of a Va-Group element of the Periodic Table and an oxide of chromium, and aluminum. The amounts of the SFE-oxide and of aluminum to the whole amount of the bath are 9.5 to 21.5 wt% and 4 to 7.5 wt%, respectively. The treating method provides the extended life of the bath, the facilitation of washing off the bath agent adhered to the treated article, etc.

11 Claims, 6 Drawing Sheets

METHOD FOR SURFACE TREATMENT AND TREATING MATERIAL THEREFOR

BACKGROUND OF THE INVENTION

1. Field of the Invention

This invention relates to a method for forming a carbide layer or a diffusion layer on the surface of an article to be treated such as a ferrous-alloy article or the like and a bath agent to be used therefor.

2. Description of the Prior Art

The ferrous-alloy article, such as a die and tools made of steel, with a carbide layer or a diffusion layer formed thereon, has greatly improved hardness and wear resistance. The above has well been known and industrialized.

The inventors have already developed a superior method for forming a diffusion layer or a carbide layer of a Va-Group element of the Periodic Table or of chromium on the surface of the article to be treated, such as the die and tools. In this surface treatment method, the article to be treated is immersed into a molten salt bath consisting essentially of borax, an oxide of a surface layer-forming element (hereafter: SFE), such as the aforementioned Va-Group element or chromium, and a reducing agent, such as aluminum, calcium, silicon or the like, to form the aforementioned surface layer (Japanese patent publication No. 4054/1978). According to this method, the reducing agent reduces the SFE-oxide to the metal thereby to recover the treating bath.

However, problems or disadvantages yet remain to be obviated in the aforementioned method. For example, when the content of reducing agent is too small relative to the amount of the SFE-oxide, there is sometimes formed no layer on the surface of the treated article. To the contrary, when the content of the reducing agent is too much, a boride layer is sometimes formed on the article, resulting in the formation of no diffusion or carbide layer of the aforesaid Va-Group element or of chromium. There are also encountered the following disadvantages. Depending on the kind of reducing agent, the viscosity of the molten bath increases. As a result, it is sometimes difficult to immerse the article to be treated into the bath, or the substance of the bath adhering to the surface of the treated article is hard to remove, which makes the surface layer on the treated article rough. Also, high viscosities result in nonuniformity of the formed layer.

To obviate the above-mentioned problems or disadvantages, the inventors engaged in extensive investigation and a large number of practical experiments, and have now completed the present invention.

SUMMARY OF THE INVENTION

Accordingly, it is an object of the present invention to provide an improved method and a bath agent for forming a diffusion layer or a carbide layer of a Va-Group element of the Periodic Table or of chromium on the surface of an article to be treated, while satisfying requirements as much as possible in connection with the viscosity of the bath, the removal of the substance of the bath from the treated article and so on.

A first aspect of the present invention is directed to an improvement in the method for forming a carbide or diffusion layer of at least one SFE, the SFE being a surface layer-forming element selected from the group consisting of a Va-Group element of the Periodic Table and chromium, on the surface of an article to be treated by immersing the article to be treated into a molten salt bath composed of borax, at least one SFE-oxide selected from the group consisting of an oxide of a Va-Group element of the Periodic Table and an oxide of chromium, and aluminum, the content of the SFE-oxide and the content of aluminum in the molten salt bath being as follows:

(A) The SFE-oxide is one or more selected from the group consisting of not more than 12 wt% of vanadium oxide, not more than 17 wt% of niobium oxide, not more than 16 wt% of tantalum oxide and not more than 21.5 wt% of chromium oxide, the total amount of the oxide or oxides being 9.5 to 21.5 wt% relative to the total amount of the molten bath; and (B) The content of aluminum is 4 to 7.5 wt% relative to the total amount of the molten bath.

A second aspect of the present invention is directed to a bath agent for forming a treating bath used for surface treatment, which is composed of borax, one or more SFE-oxides, the SFE being a surface layer-forming element selected from the group consisting of a Va-Group element of the Periodic Table and chromium, and aluminum, the content of SFE-oxide(s) and the aluminum content are as the above-mentioned (A) and (B), respectively.

BRIEF DESCRIPTION OF THE DRAWINGS

FIG. 1 is a graph showing the case in which $V_2O_5$ is used as the SFE-oxide;

FIG. 2 is a graph showing the case in which $Cr_2O_3$ is used as the SFE-oxide;

FIG. 3 is a graph showing the case in which $Nb_2O_5$ is used as the SFE-oxide;

FIG. 4 is a graph showing the case in which $Ta_2O_5$ is used as the SFE-oxide.

FIG. 5 is a graph showing the case in which $V_2O_5$ is used as the SFE-oxide;

FIG. 6 is a graph showing the case in which $Cr_2O_3$ is used as the SFE-oxide;

FIG. 7 is a graph showing the case in which $Nb_2O_5$ is used as the SFE-oxide; and FIG. 8 is a graph showing the case in which $Ta_2O_5$ is used as the SFE-oxide.

DETAILED DESCRIPTION OF THE INVENTION

Figure 1:
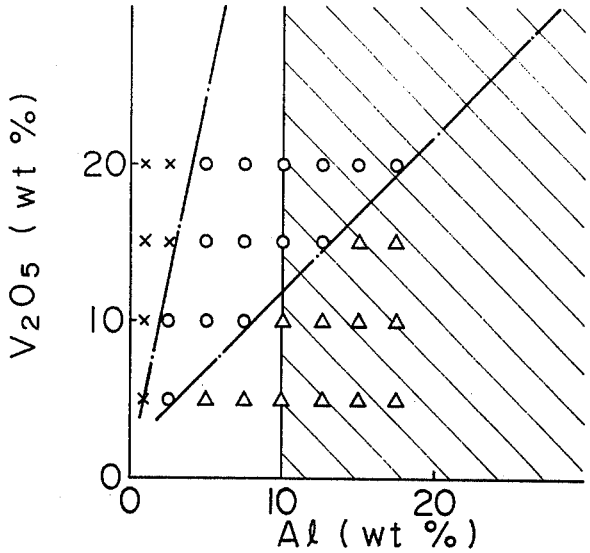
FIGS. 1 to 4 illustrate the effect of the SFE-oxide content and of the Al content in a borax bath on the formation of the surface layer.

The above-mentioned surface treating method and salt bath according to this invention are characterized in that aluminum is used as a reducing agent for reducing the SFE-oxide or oxides in the molten bath and the composition ratios of the SFE-oxide or oxides and of aluminum to the whole amount of the bath are within specified ranges.

Aluminum is selected as the reducing agent because it has no such drawbacks as those residing in other reducing agents. When silicon is used as the reducing agent, the viscosity of the bath significantly increases so that it is difficult to immerse an article to be treated into the bath. When calcium, zirconium and manganese are used, washing of the substance of the bath cannot be easily performed. This results in making the surface of the treated article rough. When titanium is used, the surface layer formed on the treated article is nonuniform. A rare-earth element is not suitable because the amount thereof present on the earth is very small. However, aluminum does not have such disadvantages as described above.

In the present invention, the ratio of each of the SFE-oxide and aluminum to the whole amount of the bath is specified in the above-mentioned range for the following reasons.

Namely, the viscosity of the substance of the bath, washing performance thereof and the efficiency to prevent the oxidation of the treated article after removal from the bath are determined by the amount of the SFE-oxide contained in the molten bath. When the amount of the SFE-oxide is large, the viscosity of the bath increases, resulting in increment of the adhesion amount of the substance of the bath to the treated article. And the time required to wash off the substance of the bath also increases, accordingly. To the contrary, when the amount of the SFE-oxide is small, there are encountered the oxidation of the treated article. According to the present invention, it is possible to satisfactorily prevent the oxidation of the treated article after taking it out of the bath and the amount of the substance of the bath carried out from the bath is also minimum. In addition, the washing time is short. In other words, the present invention has found and specified the most suitable content of the SFE-oxide in the molten bath to satisfy all the above-mentioned features.

The molten bath, in which the SFE-oxide or oxides and aluminum (Al) are dissolved, is lowered in the performance to form the surface layer on the treated article as time passes. Thus, the deterioration of the bath occurs. The deterioration of the bath depends upon the amount of aluminum contained in the molten bath. The less amount of aluminum will be liable to lower the performance to form the surface layer. However, if the amount of aluminum is too much, it is difficult to dissolve aluminum into the molten bath and aluminum is extricated in the form of the single substance. The extricated aluminum reacts with the vessel and the article to be treated to corrode them. The present invention has found and specified the most suitable amount of aluminum to be contained in the molten bath. According to the specified amount of aluminum, there are encountered no extrication of aluminum in the molten bath and also no deterioration of the bath which comes into question in the practical operation.

Hereinafter, the present invention will be described in more detail.

In the present invention, borax ($Na_2B_4O_7$) is a main aspect agent of the surface treating agent.

As the SFE-oxide, there are used one or more selected from the group consisting of an oxide of a Va-Group element of the Periodic Table [such as vanadium (V), niobium (Nb), tantalum (TA)] and an oxide of chromium (Cr).

As the above-mentioned SFE-oxide, $V_2O_5$, $Nb_2O_5$, $Ta_2O_5$, $Cr_2O_3$, $NaVO_3$, $K2CrO_4$ and the like can be used. The most practical one is $V_2O_5$ or $Cr_2O_3$. The oxide or oxides act as a source for the surface layer-forming element (SFE). The SFE easily and quickly dissolves in the molten bath because it is in the form of oxide. Therefore, there occurs no deposition thereof at the bottom of the bath.

The SFE oxide is one or more selected from the group consisting of vanadium oxide, niobium oxide, tantalum oxide and chromium oxide and the amounts thereof are respectively 12% by weight (wt%) or less, 17 wt% or less, 16 wt% or less and 21.5 wt% or less relative to the whole amount of the bath agent. The total amount of the SFE-oxide or oxides is within a range of 9.5 to 21.5 wt%.

When the amount of the SFE-oxide or oxides exceed the upper limit of the specified range, the amount of the substance of the bath carried out from the bath increases so that it takes much time to wash off the substance of the bath adhering to the treated article. On the other hand, when the amount of the SFE-oxide or oxides are less than the lower limit of the specified range, oxidation of the treated article is liable to occur.

In case where only one of the SFE-oxides is used, it is preferable that the amount of each SFE-oxide is in the following range:

(a) Vanadium oxide: 9.5 to 12 wt%
(b) Niobium oxide: 14 to 17 wt%
(c) Tantalum oxide: 14 to 16 wt%
(d) Chromium oxide: 19 to 21.5 wt%

Each of the SFE-oxides exhibits superior characteristics within the above-mentioned range to form a diffusion or carbide layer on an article to be treated.

Aluminum acts as a reducing agent for reducing the SFE-oxide or oxides. In other words, the SFE-oxide is reduced to metal by aluminum in the molten bath in which the bath agent is dissolved, to form a surface layer of carbide or diffusion on the surface of the treated article. Since oxygen entered in the bath during the treatment bonds with aluminum, a long life of the bath can be obtained. The purity of aluminum is preferably about 90 to 99.9%. The aluminum content in the bath agent is in a range of from 4 to 7.5 wt% of the whole amount of the bath agent. When it is less than 4 wt%, the life of the bath is short, but when more than 7.5 wt%, a boronizing layer is sometimes formed.

Borax in the surface treating agent is usually in the form of powder. The SFE-oxide is preferably used in the form of powder or flakes, and aluminum is preferably used in the form of mass, powder or granules.

By using a surface treating agent according to the present invention, a surface layer is formed on an article to be treated as follows. More particularly, a molten bath is prepared from the surface treating agent and an article to be treated is immersed in the molten bath to form a carbide layer or a diffusion layer of SFE, such as a Va-Group element or chromium on the surface of the treated article.

The material of an article to be treated may be ferrous alloy, cemented carbide, nickel alloy, cobalt alloy, cermet, carbon material or the like. When enough carbon to form a carbide of the SFE is contained in the article to be treated, is formed a surface layer composed mainly of the carbide thereon. In order to form this carbide layer, it is preferable to use an article containing 0.1% or more of carbon as the article to be treated. On the other hand, when the carbon content in the article to be treated is too small or none, there is formed a surface layer composed mainly of a solid solution layer of the SFE and the substrate element on the surface of the treated article (the solid solution layer being called a diffusion layer in this invention). In this case, no carbide layer is formed on the treated article. In case where carbon is added into the bath or a vessel made of a material containing carbon such as graphite or the like is used, there can be formed a surface layer composed mainly of a carbide.

The treating temperature is optionally within a range of from 700° to 1250° C. and in practice, it is preferably within a range of from 850° to 1100° C. At a temperature below 850° C., it takes much time to treat the article. On the other hand, at a temperature above 1100° C., the lives of the bath and of the vessel are short. Although the treating time depends upon the thickness of the surface layer to be formed, usually, it is selected from a range of from 1 to 20 hours.

In order to lower the fusing temperature of the bath agent and to change the viscosity thereof, halides such as sodium chloride (NaCl), potassium chloride (KCl), sodium fluoride (NaF); oxides such as phosphorus oxide ($P_2O_5$) and the like; hydroxides such as sodium hydroxide (NaOH), potassium hydroxide (KOH); sulfates and carbonates, may be added to the surface treating agent according to this invention. Although these additives can lower the melting point of the bath agent, they cause intensive corrosion so that an apparatus and others used for the surface treatment are corroded by them. Therefore, in adding these additives, care should be given to the following matters. Namely, depending on the kind of the article to be treated, the thickness of the carbide layer to be formed, the method of heat treatment, the treating temperature and the like, appropriate conditions should be selected.

The present invention provides an improved treating method for forming a diffusion or carbide layer of a Va-Group element of the Periodic Table or of chromium on the surface of an article to be treated and an improved bath agent therefor. The improved method and bath agent satisfy the various requirements such as (1) long life of the bath, (2) facilitation of washing off the bath agent adhering to the treated article, (3) less occurrence of the oxidation of the treated article during cooling, (4) easiness of making the bath, (5) uniform temperature distribution in the bath, and (6) reduced cost of the bath agent.

The invention is now described with reference to the following Examples.

EXAMPLE 1

Dehydrated borax ($Na_2B_4O_7$) was introduced into a crucible made of heat-resistant steel and heated in an electric furnace to melt the borax. A bath of 950° C. was prepared. Into the bath, there were added 12 wt% of $V_2O_5$ flakes of the whole amount of the bath (including borax, $V_2O_5$ and a reducing agent) and 1 to b 10 wt% of each of various kinds of reducing agents of under 100 meshes as shown in TABLE of the whole amount of the bath, thereby to prepare many kinds of treating baths. The rod like test pieces made of JIS SK 4 (carbon tool steel) with a diameter of 7 mm were immersed into each of the molten salt baths and kept therein for 2 hours, taken out therefrom and air-cooled. Then, the weight of the bath agent adhering to the test pieces was measured and any bath agent adhering thereto was removed by washing with hot water. In this connection, the washing time was measured and the surface of each of the treated test pieces was observed in order to know the washing-off condition of the bath agent from the treated test piece and the adhesion condition thereof. Subsequently, the resulting test pieces were cut and cross sections of each were observed micrographically in order to measure uniformity of the surface layer formed on the treated test pieces.

On the other hand, dehydrated borax ($Na_2B_4O_7$) introduced into a crucible was admixed with 12 wt% of flaky $V_2O_5$ based on the whole amount of the bath and there was also added thereinto 4 wt% of each of the reducing agents as shown in TABLE based on the whole amount of the bath, and the mixture was heated at 1000° C. to make many kinds of molten salt baths. The rod like test piece made of JIS SK 4 (carbon tool steel) with a diameter of 7 mm was immersed into each of the molten salt baths once a day for 30 minutes at a predetermined time in order to observe the presence of the surface layer on the treated piece and thereby to evaluate the life of the bath (i.e., to know the number of days before the height of that part of the bath which is usable for the formation of the layer reaches a half of the distance between the bottom of the crucible and the upper surface of the bath).

The amount of the bath agent carried out from the bath, the washing-off condition of the bath agent, the life of the bath, etc. on each test piece are shown in TABLE. As is apparent from TABLE, when silicon is used as the reducing agent, a large amount of the bath agent is carried out from the bath together with the treated article. When calcium, zirconium and manganese are used, the bath agent is hard to be washed off. When titanium is used, a uniform surface layer can not be formed. When ferrous alloy containing these elements is used, the washing is hard and the bath agent is liable to adhere to the treated article. On the other hand, aluminum has no problems as described above and is superior as the reducing agent.

In items 2, 5, 6, 8, 9 and in judgement of TABLE, mark ○ represents the result of the corresponding item is good, mark Δ represents the result is a little poor and mark X represents the result is poor. In items 1, 3 and 7, the mark ○ represents the amount of the corresponding item is small, mark Δ represents it is a little large and mark X represents it is large.

In item 4, mark ○ represents the life of the bath is long, mark Δ represents it is a little short and mark X represents it is short.

In item 10, mark ○ represents the cost of the bath agent is inexpensive, mark Δ represents it is a little expensive and mark X represents it is expensive.

TABLE

| | Item No. | | | | | | | | | | |
|---|---|---|---|---|---|---|---|---|---|---|---|
| reducing agent | 1 amount of bath agent carried out from the bath | 2 washing off of bath agent | 3 adhesion of bath agent | 4 life of bath | 5 facilitation to make bath | 6 uniformity of bath temperature | 7 amount of bath agent required to form layer | 8 uniformity of surface layer | 9 ability to prevent oxidation of treated article | 10 cost of bath agent | judgement |
| Al | Δ | ○ | ○ | ○ | Δ | Δ | ○ | ○ | ○ | ○ | ○ |
| Ca | Δ | X | X | X | Δ | Δ | ○ | ○ | ○ | Δ | X |
| Si | X | X | X | Δ | X | X | ○ | ○ | ○ | ○ | X |

TABLE-continued

| reducing agent | Item No. 1 amount of bath agent carried out from the bath | 2 washing off of bath agent | 3 adhesion of bath agent | 4 life of bath | 5 facilitation to make bath | 6 uniformity of bath temperature | 7 amount of bath agent required to form layer | 8 uniformity of surface layer | 9 ability to prevent oxidation of treated article | 10 cost of bath agent | judgement |
|---|---|---|---|---|---|---|---|---|---|---|---|
| Ti | Δ | ○ | Δ | X | X | Δ | Δ | X | Δ | ○ | X |
| Zr | Δ | X | X | ○ | Δ | Δ | Δ | ○ | ○ | ○ | X |
| Mn | ○ | X | X | X | Δ | ○ | X | X | X | ○ | X |
| Ca—Si | Δ | X | X | X | ○ | Δ | ○ | ○ | ○ | ○ | X |
| Fe—Al | Δ | ○ | X | Δ | Δ | Δ | Δ | ○ | ○ | ○ | X |
| Fe—Si | X | X | X | X | Δ | X | ○ | ○ | ○ | ○ | X |
| Fe—Ti | Δ | ○ | X | X | Δ | Δ | X | X | Δ | ○ | X |
| Fe—Zr | Δ | X | X | Δ | Δ | Δ | Δ | ○ | ○ | ○ | X |
| Fe—Mn | ○ | X | X | X | Δ | ○ | X | ○ | X | ○ | X |
| Fe—B | ○ | ○ | X | Δ | ○ | Δ | Δ | ○ | ○ | ○ | X |

EXAMPLE 2

Dehydrated borax ($Na_2B_4O_7$) was introduced into a crucible made of heat-resistant steel and heated in an electric furnace to melt the borax. A bath of 950° C. was prepared. A molten salt bath was made by adding $V_2O_5$ flakes and then a mass of Al little by little while stirring the prepared bath. Many kinds of baths were prepared by variously changing the amounts of $V_2O_5$ and of Al. A rod like test piece made of JIS SK 4 (carbon tool steel) with a diameter of 7 mm was immersed into each of the treating baths and kept therein for 2 hours, taken out therefrom and cooled in oil baths. Any bath agent adhering to the surface of the test pieces was removed by washing with hot water. After cutting the test pieces, cross sections of each were observed micrographically. The results are shown in FIG. 1, wherein the ordinate represents the content of $V_2O_5$ in the baths, the abscissa represents the content of Al in the baths. Also, mark o represents a test piece on which a VC layer was formed, mark Δ represents a test piece on which a layer of FeB or $Fe_2B$ was formed and mark X represents a test piece on which no layer was formed. (These symbols have the same meanings throughout the Figures.)

For example, baths containing 10 wt% of $V_2O_5$ and 5 or 7.5 wt % of Al formed a layer of VC with a 7 μm thickness. However, baths containing 10 wt% of Al or 15 wt% of Al did not form a vanadium carbide layer or a diffusion layer of vanadium, because they formed exclusively a $Fe_2B$ layer, respectively. In any case, the surfaces of all treated test pieces were smooth and no powder adhesions were observed. In the figure, the area between dot-dash lines shows the composition range in which a VC layer can be formed, and it is seen from this that within the Al amount of about 20 to 78% relative to the amount of $V_2O_5$, a VC layer is formed. In the figure, the shadowed area shows the presence of extricated Al in the molten bath. It is seen from the figure that the extrication of Al occurs in the treating bath when more than 10 wt% of Al based on the whole amount of the bath is added regardless of the amount of $V_2O_5$. The Al extricated in the molten bath corrodes an article to be treated, jig, vessel and the like and therefore, it is impossible to treat an article to be treated in a bath which substantially has a composition ratio included in the shadowed area. It is evident from this that a VC layer can be formed on the treated article with a composition ratio present only in the area where the shadowed area is excluded from the area between dot-dash lines.

EXAMPLE 3

Like Example 2, many different treating baths were prepared from borax (as the main agent), different types and amounts of SFE-oxides and different amounts of Al. Rods made of JIS SK 4 with a diameter of 7 mm were prepared as articles to be treated and immersed in separate molten salt baths to form a surface layer thereon. The results are shown in FIGS. 2 to 4.

Figure 2:
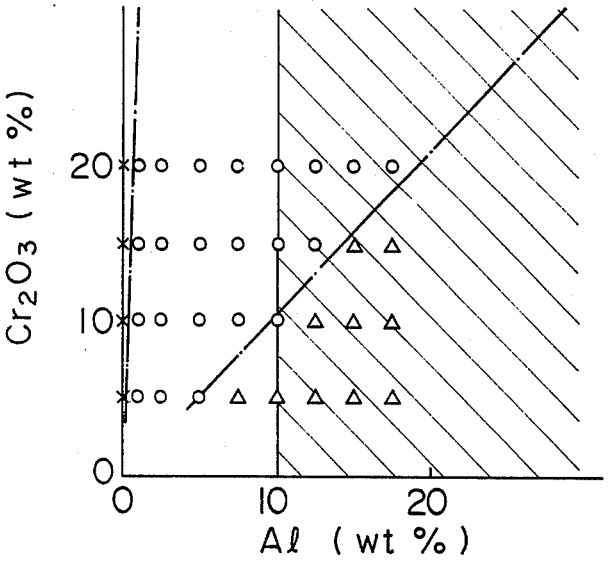

FIG. 2 reflects a result obtained by using $Cr_2O_3$ as SFE-oxide. As is seen from FIG. 2, when $Cr_2O_3$ and Al were used, $Cr_7C_3$ or $Cr_{27}C_6$ was formed in treating-bath compositions with Al in an amount of about 90% or less based on the amount of $Cr_2O_3$. On the other hand, when more than 10 wt% of Al based on the whole amount of the bath was added regardless of the amount of $Cr_2O_3$, Al was extricated in the molten bath.

Figure 3:
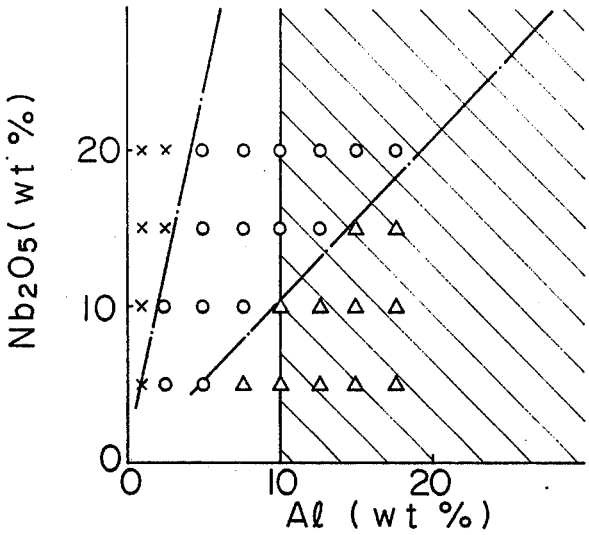

FIG. 3 reflects a result obtained by using $Nb_2O_5$ as SFE-oxide. It is seen from this that suitable treating-bath compositions include Al in an amount of from about 20 to 95% based on the amount of $Nb_2O_5$. A NbC layer was formed in a ratio of Al to $Nb2O_5$ within this range. When more than 10 wt% of Al of the whole amount of the bath was added regardless of the amount of $Nb_2O_5$, Al was extricated in the molten bath.

Figure 4:
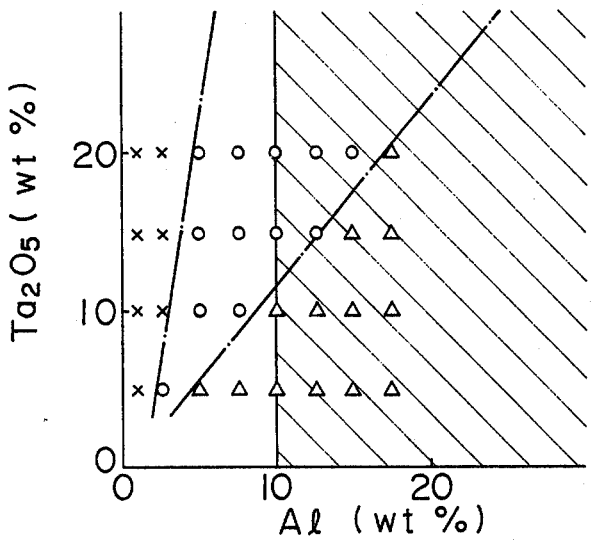

FIG. 4 reflects a result obtained by using $Ta_2O_5$ as SFE-oxide. It is seen from this that suitable treating-bath compositions include Al in an amount of from about 30 to 85% based on the amount of $Ta_2O_5$. A TaC layer was formed in a ratio of Al to $Ta_2O_5$ within this range. When there was added more than 10 wt% of Al of the whole amount of the bath regardless of the amount of $Ta_2O_5$, Al was extricated in the molten bath.

As previously mentioned, a molten salt bath, in which a SFE-oxide or oxides and Al are incorporated, is used in the present invention. The formation of a carbide layer on the surface of an article to be treated is confirmed by the fact that, as a result of reduction of the oxide or oxides due to Al, a SFE metal appears in the bath.

EXAMPLE 4

Figure 5:
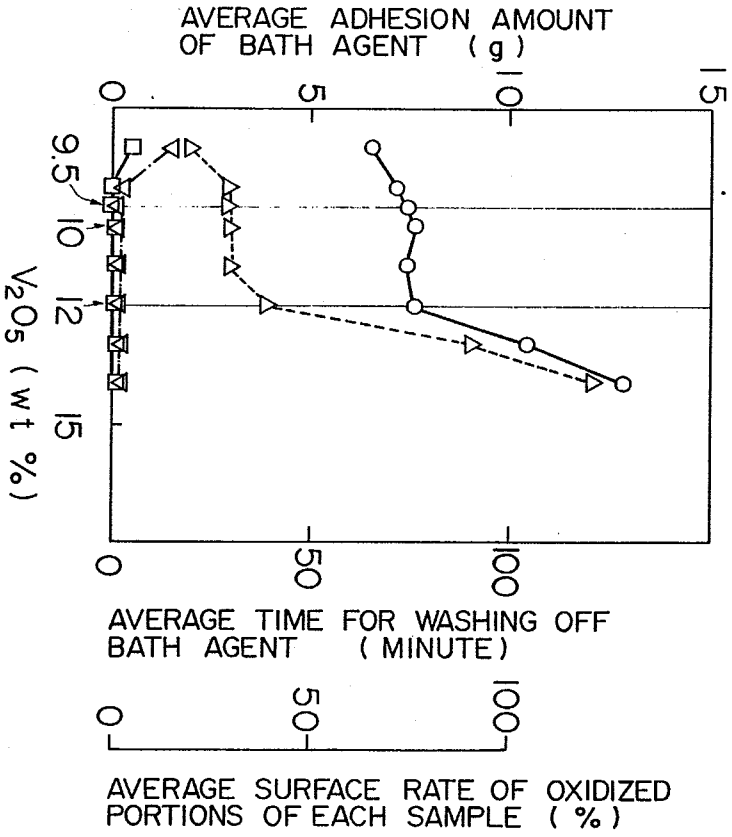
FIGS. 5 to 8 illustrate the effect of the SFE-oxide content on the adhesion of the bath agent, the time required to wash off the bath agent and the oxidation condition of the treated article.

Dehydrated borax ($Na_2B_4O_7$) was introduced into each of pots made of heat-resistant steel and heated in an electric furnace to melt the borax. A bath of 1000° C. was prepared in each pot. To each of the baths, there was added 6.5 wt% of a mass of Al based on the whole amount of the bath. And then, 8 wt%, 9 wt%, 10 wt%, 11 wt%, 12 wt%, 13 wt% and 14 wt% of $V_2O_5$ flakes of the whole amount of the bath were also added thereinto, respectively, so as to be 2 kg in the total amount thereof. Two disk shaped test pieces of $\phi 34 \times 10$ mm made of JIS S 45 C were immersed into each of these different baths for 2 hours every day for 5 days. One of them was air-cooled immediately thereafter thereby to obtain Sample No. 1. The other was kept for 10 minutes just above the bath surface (810° to 890° C.) and then air-cooled thereby to obtain Sample No. 2. The weight of the bath material adhering to the Sample No. 1 was measured. Then, the two Samples (No. 1 and No. 2) were washed with hot water to remove the treating material therefrom and the washing time thereof was measured. Further, the surface rate of oxidized portions of the resulting Samples was measured. There was taken an average of the results on each Sample for five days and the results are shown in FIG. 5. In FIG. 5, the ordinate represents the average amount by weight of the bath agent adhered to the Sample, the average time required to wash off the bath agent adhered thereto, and the average surface rate of the oxidized portions of the Samples, and the abscissa represents the $V_2O_5$ content in the bath. In this Figure, mark o represents the average of the adhesion amount of the bath agent, mark Δ represents the average of the washing time required to remove the bath agent, and marks □ and ∇ represent the average of the surface rate of the oxidized portions of each Sample (mark □ showing the surface rate of Sample No. 1 and mark ∇ showing the surface rate of Sample No. 2).

Figure 6:
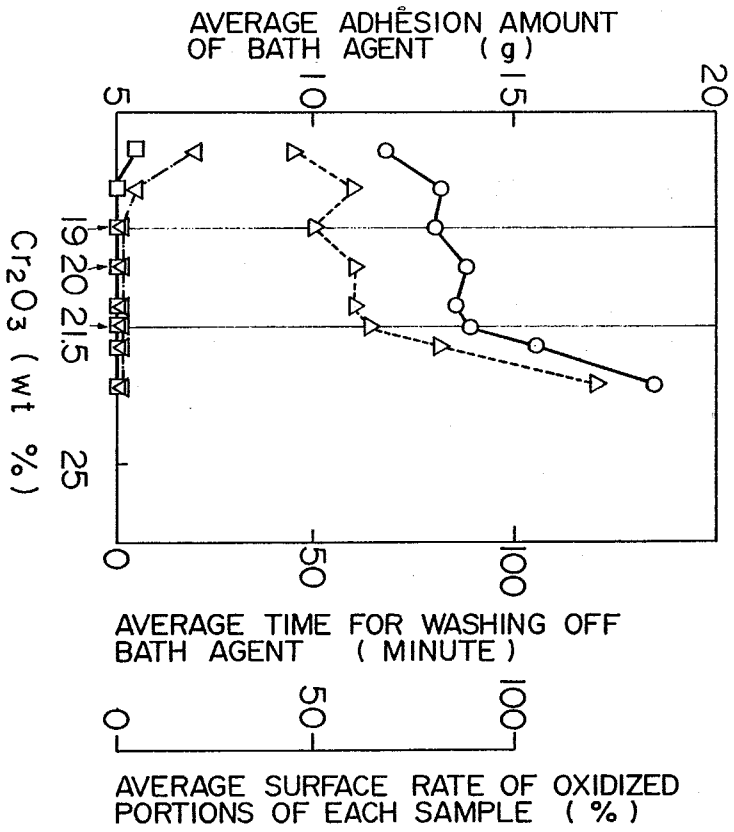
Figure 7:
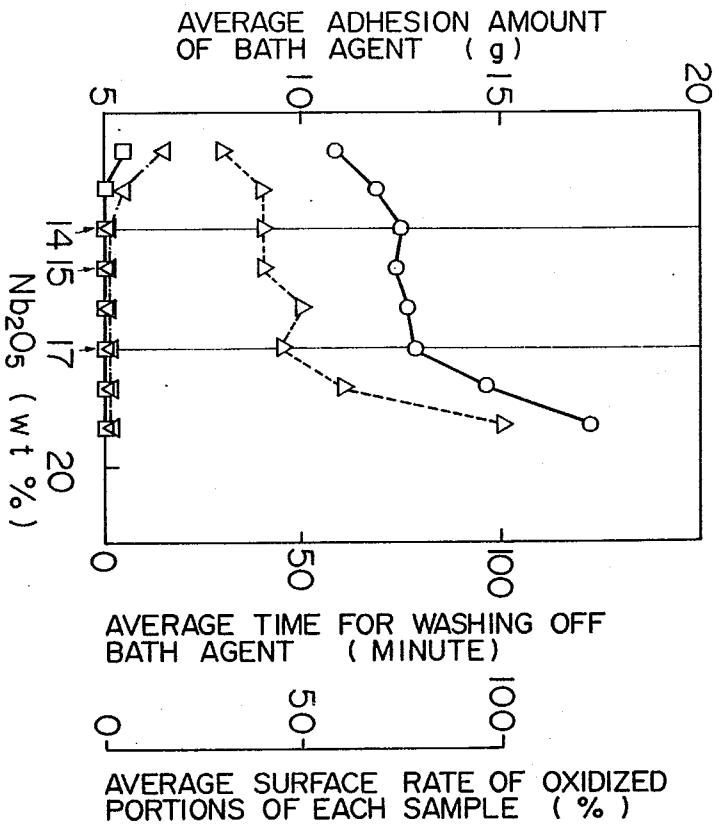
Figure 8:
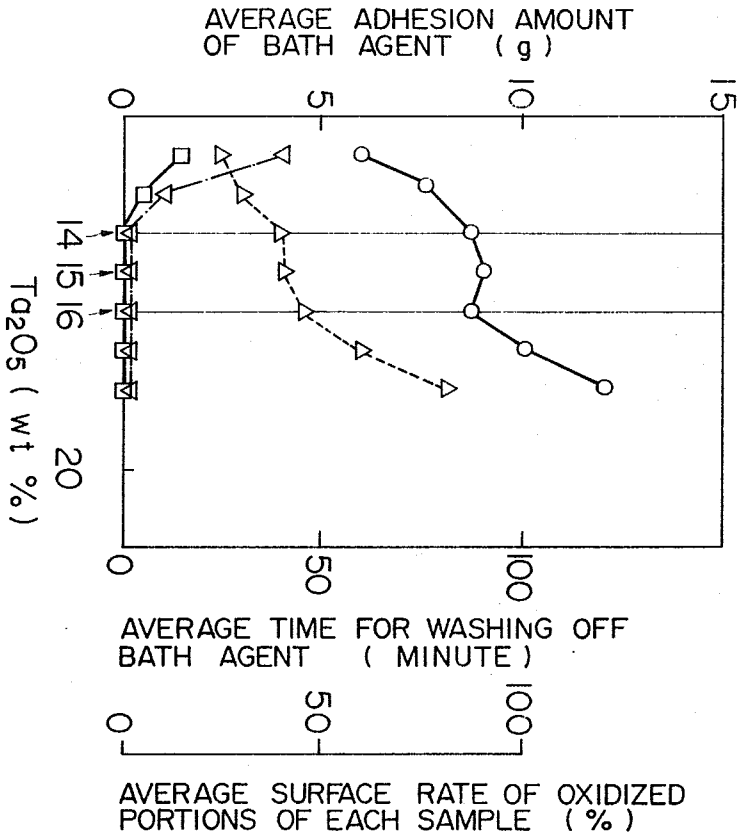

In FIGS. 6, 7 and 8, there are shown the results obtained by changing the amounts of SFE-oxides added to the bath, i.e. $Cr_2O_3$, $Nb_2O_5$ and $Ta_2O_5$, respectively, in the same manner as in FIG. 5.

There are shown in FIG. 5 the case of $V_2O_5$ used as the SFE-oxide, wherein as the content of $V_2O_5$ increases, the adhesion of the bath agent also increases. It is seen from this that the viscosity of the bath agent increases. When the amount of $V_2O_5$ based on the whole amount of the bath is within a range of from 9 to 12 wt %, the adhesion amount of the bath agent increases only slightly. However, when it exceeds 13 wt%, the adhesion amount thereof rapidly increases. The washing time is not so different within the range of from 9 to 12 wt% of the $V_2O_5$ content. However, when the amount of $V_2O_5$ exceeds 13 wt%, the washing time also rapidly increases. As to the oxidation during cooling of the sample, there occurred a little oxidation on the surface of the sample when it was treated in a treating bath containing 9 wt% of $V_2O_5$ and then slowly cooled. However, when the amount of $V_2O_5$ was 9.5 wt% or more, the sample was not oxidized even if it was cooled slowly. It is considered from the above result that the $V_2O_5$ content in a suitable bath agent is 9.5 to 12 wt% based on the whole amount of the bath, that is, in the aforesaid composition range of $V_2O_5$, the amount of the bath agent carried out from the bath is a little, the washing time is short and the sample was not also oxidized. In the meantime, the thickness of a VC layer formed on the samples did not change even when the $V_2O_5$ content was changed.

In FIG. 6, there are shown results obtained by using $Cr_2O_3$ as the SFE-oxide. In this case, the adhesion amount of the bath agent, the time required to wash off the bath agent, the oxidation condition of the treated samples were also the same as in the case of $V_2O_5$. The most suitable content of $Cr_2O_3$ was considered to be from 19.0 to 21.5 wt % of the whole amount of the bath.

In FIG. 7, there are shown results obtained by using $Nb_2O_5$ as the SFE-oxide. This case also showed the similar tendency. The most suitable content of $Nb_2O_5$ was from 14 to 17 wt% of the whole amount of the bath.

In FIG. 8, there are shown results obtained by using $Ta_2O_5$ as the SFE-oxide. The tendency was the same as in the above. The most suitable content of $Ta_2O_5$ was 14 to 16 wt% of the whole amount of the bath.

EXAMPLE 5

Dehydrated borax ($Na_2B_4O_7$) was introduced into each of three pots made of heat-resistant steel and heated in an electric furnace to melt the borax. A bath of 1000° C. was prepared. To each bath, there was added 10 wt% of $V_2O_5$ flakes of the whole amount of the bath. And subsequently, 3 wt%, 5 wt% and 7.5 wt% of a mass of Al of the whole amount of the bath were further added into the three baths, respectively, so as to be 6 kg in the total weight of each bath. In the same manner as in Example 1, there was immersed a rod like test piece made of JIS SK 4 (carbon tool steel) with a diameter of 7 mm into each of these baths, once a day at a predetermined time and it was kept therein for 30 minutes to measure the life of the bath from presence of the formed surface layer on the treated test pieces. As to the bath into which 3 wt% of Al was added, the height of the bath usable for the formation of the surface layer was rapidly reduced and the life of the bath was only 2 days. On the other hand, as to the baths into which 5 wt% and 7.5 wt% of Al were added, respectively, the lives of the baths were about 11 and 18 days, respectively. In practice, a life of the bath should be about 6 days and therefore, an addition of 4 wt% or more of Al is considered to be necessary. In view of the relation between the contents of $V_2O_5$ and Al in the treating bath required to form a surface layer (as shown in Example 2), the most suitable Al content is 4 to 7.5 wt% of the whole amount of the bath.

On the other hand, as to treating baths into which $Cr_2O_3$, $Nb_2O_5$ and $Ta_2O_5$ were respectively added as SFE-oxides in place of $V_2O_5$, the same experiment as the above was carried out. The results were also the same and the most suitable content of Al in each case was as follows:

| | |
|---|---|
| $Cr_2O_3$:Al | 4 to 7.5 wt % |
| $Nb_2O_5$:Al | 4 to 7.5 wt % |
| $Ta_2O_5$:Al | 4 to 7.5 wt % |

Moreover, by changing the amount of Al to be added, there were measured the adhesion amount of the bath agent to the treated sample, the time required to wash off the bath agent and the surface rate of oxidized portions of the sample, in the same manner as in Example 4. In any use of $V_2O_5$, $Cr_2O_3$, $Nb_2O_5$ and $Ta_2O_5$, the change of the Al content in the range of from 4 to 7.5 wt% based on the whole amount of the bath did not affect the values of the above factors.

What is claimed is:

1. A method for forming a carbide or diffusion layer on an article to be treated, comprising:

preparing a molten salt bath comprising borax, at least one oxide of a surface layer forming element (SFE) selected from the group consisting of an oxide of a Va-Group element of the Periodic Table and an oxide of chromium, and aluminum, said at least one SFE-oxide being selected from the group consisting of not more than 12 wt% of vanadium oxide, not more than 17 wt% of niobium oxide, not more than 16 wt% of tantalum oxide and not more than 21.5 wt% of chromium oxide, the total amount of said at least one SFE-oxide being 9.5 to 21.5 wt% based on the whole amount of the salt bath, and the amount of said aluminum being 4 to 7.5 wt% based on the whole amount of the salt bath; and immersing the article to be treated in said salt bath.

2. A method according to claim 1, wherein said at least one SFE-oxide is vanadium oxide in an amount of 9.5 to 12 wt% based on the whole amount of the salt bath.

3. A method according to claim 1, wherein said at least one SFE-oxide is niobium oxide in an amount of 14 to 17 wt% based on the whole amount of the salt bath.

4. A method according to claim 1, wherein said at least one SFE-oxide is tantalum oxide in an amount of 14 to 16 wt% based on the whole amount of the salt bath.

5. A method according to claim 1, wherein said at least one SFE-oxide is chromium oxide in an amount of 19 to 21.5 wt% of the whole amount of the salt bath.

6. A method according to claim 1, wherein the temperature of said molten salt bath is within the range of from 700° C. to 1250° C.

7. A bath agent for forming a carbide or diffusion layer on an article to be treated, comprising borax, at least one oxide of a surface layer forming element (SFE) selected from the group consisting of an oxide of a Va-Group element of the Periodic Table and an oxide of chromium, and aluminum, said at least one SFE-oxide being selected from the group consisting of not more than 12 wt% of vanadium oxide, not more than 17 wt% of niobium oxide, not more than 16 wt% of tantalum oxide and not more than 21.5 wt% of chromium oxide, the total amount of said at least one SFE-oxide being 9.5 to 21.5 wt% based on the whole amount of the bath agent, and the amount of said aluminum being 4 to 7.5 wt% based on the whole amount of the bath agent.

8. A bath agent according to claim 7, wherein said at least one SFE-oxide is vanadium oxide in an amount of 9.5 to 12 wt% based on the whole amount of the bath agent.

9. A bath agent according to claim 7, wherein said at least one SFE-oxide is niobium oxide in an amount of 14 to 17 wt% based on the whole amount of the bath agent.

10. A bath agent according to claim 7, wherein said at least one SFE-oxide is tantalum oxide in an amount of 14 to 16 wt% based on the whole amount of the bath agent.

11. A bath agent according to claim 7, wherein said at least one SFE-oxide is chromium oxide in an amount of 19 to 21.5 wt% based on the whole amount of the bath agent.

* * * * *